United States Patent [19]

Ito

[11] 4,261,571

[45] Apr. 14, 1981

[54] MECHANICAL SLOT MACHINE

[76] Inventor: Yoshie Ito, c/o Wagner Shokai Inc., 14-4, 2-chome, Yanagibashi, Taito-ku Tokyo, Japan

[21] Appl. No.: 84,844

[22] Filed: Oct. 15, 1979

[30] Foreign Application Priority Data

Dec. 18, 1978 [JP] Japan ..... 53/154910

[51] Int. Cl.[3] ..... A63F 5/04

[52] U.S. Cl. ..... 273/143 R; 46/4

[58] Field of Search ..... 273/143 R, 143 A, 143 B, 273/143 C, 143 D, 143 E, 138 R, 138 A; 46/2, 3, 4; 194/DIG. 11

[56] References Cited

U.S. PATENT DOCUMENTS

| | | | |
|---|---|---|---|
| 3,406,976 | 10/1968 | Van Woert, Jr. | 273/143 R |
| 3,464,693 | 9/1969 | Bailey | 273/1 R |
| 3,565,441 | 2/1971 | Matsumoto | 273/143 R |
| 4,002,335 | 1/1977 | Bailey | 273/1 E |
| 4,037,845 | 7/1977 | Hooker | 273/138 A |
| 4,097,048 | 6/1978 | Poulsen et al. | 273/143 R |

*Primary Examiner*—Richard C. Pinkham
*Assistant Examiner*—Arnold W. Kramer

[57] ABSTRACT

A mechanical slot machine worked by springs, comprising rotatable drums bearing pictures, symbols, etc. on their peripheries, a kicker for rotating the drums, a movable frame for controlling drum stoppers and for detecting the stop positions of the drums to control discharging of coins, drum stoppers for stopping the drums in regular sequence and at regular intervals, and an actuating lever. Upon pulling the actuating lever forward once, the mechanism automatically rotates the drums for a period of time, stops them in regular sequence and at intervals, and discharges coins according to the combinations of pictures, symbols, etc. obtained.

5 Claims, 8 Drawing Figures

(I)

(II)

MECHANICAL SLOT MACHINE

BACKGROUND OF THE INVENTION

1. Field of the Invention

The present invention relates to mechanical slot machines for amusement. More particularly, the invention relates to mechanical slot machines which are worked by springs and have no electric motor, electromagnets or the like and which, by a simple operation of pulling an actuating lever forward, automatically rotate for a period a plurality of rotatable drums bearing pictures, symbols, etc., on their peripheries, automatically stop the rotatable drums in regular sequence and at intervals, and automatically discharge coins according to the combinations of pictures, symbols, etc., arranged horizontally.

2. Description of the Prior Art

Drum-type slot machines designed to discharge coins according to the combinations of pictures, symbols, etc., shown on the peripheries of a plurality of rotatable drums have been widely known. Most of them have been electrically driven slot machines using an electric motor to rotate the drums and electromagnets to stop them. Because these electrically driven slot machines need not only the electric motor and electromagnets but also a battery or other power source, they have had large and complicated mechanisms and have been expensive.

Therefore, a number of mechanical slot machines which rotate drums by utilizing mechanical energy, such as the force of springs and which have no electric motor or electromagnets, have been disclosed as found in U.S. Pat. Nos. 4,097,048, 4,037,845 and 3,565,441. However, these mechanical slot machines have been either complicated in mechanism and not easy to operate or, on the contrary, too simple in construction to perform such function as makes the game exciting. For instance, some of the former have had stop buttons, one for each drum, to stop drums which have been rotated by means of an actuating lever. These have had the disadvantage that they require several manual operations from the starting of the drums to the stopping of the drums and therefore make the game complicated. On the other hand, some of the latter have been designed to stop the drums automatically by a stopper incorporated therein, not by stop buttons. Because slot machines of this kind stop a plurality of drums simultaneously in a relatively short time and cannot stop them one by one at intervals, they have had a disadvantage that the arrangement of pictures, symbols, etc., on the drums, when stopped, is liable to show a certain pattern or tendency and therefore the fairness of the game is not maintained.

BRIEF SUMMARY OF INVENTION

It is therefore a general object of this invention to provide a novel mechanical slot machine which has obviated all the above mentioned disadvantages of the slot machines of the prior art.

It is a specific object of this invention to provide a mechanical slot machine which, by the single operation of pulling an actuating lever, automatically performs a series of actions of rotating drums, stopping them in regular sequence after the lapse of a certain period of time, detecting their stop positions, and discharging coins according to the stop positions.

These and other objects have been attained by a mechanical slot machine which comprises a plurality of rotatable drums; a kicker adapted to rotate the drums by the force of a spring; a movable frame interlocked through a one-way clutch with a timing mechanism and adapted to control drum stoppers and to detect the stop positions of the drums so as to control discharging of coins; drum stoppers adapted to stop the drums in regular sequence and at intervals; and an actuating lever.

These and other objects and advantages of the invention will appear more fully from the following description.

DETAILED DESCRIPTION

Figure 1:
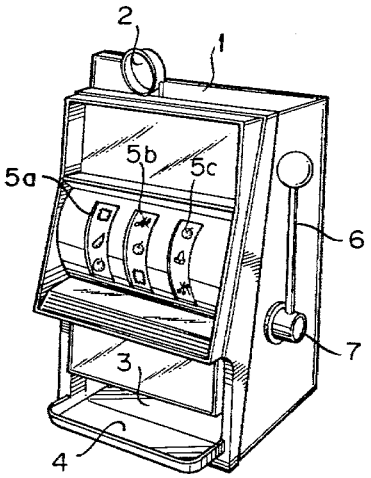
FIG. 1 is a perspective view illustrating the appearance of a mechanical slot machine embodying the invention.
Figure 3:
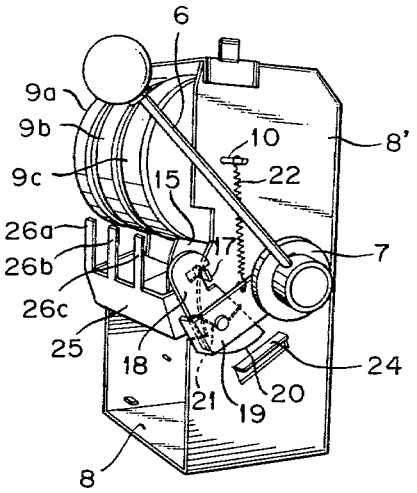
FIG. 3 is a perspective view of the same seen sideways from front.
Figure 2:
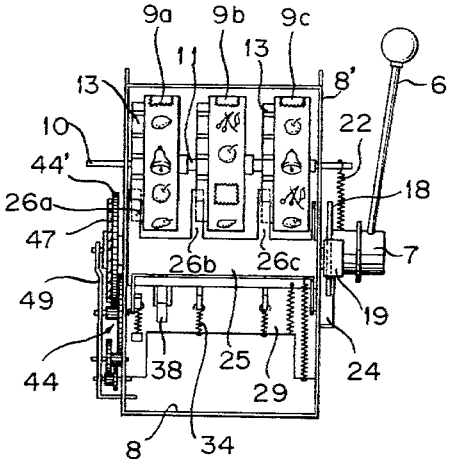
FIG. 2 is a front view illustrating the interior construction thereof.
Figure 4:
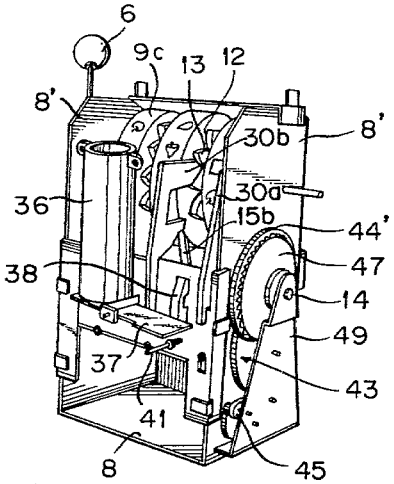
FIG. 4 is a perspective view of the same seen sideways from rear.

The present invention will now be described in detail with reference to embodiments illustrated in the drawings. In FIG. 1, numeral 1 represents a casing of a mechanical slot machine embodying the invention. The casing 1 is provided at its top with a coin slot 2, and at its bottom with a coin outlet 3 and a tray 4 adjacent thereto. The casing 1 is provided at its frontal center portion with a plurality of windows 5 which expose portions of rotatable drums contained in the casing 1. The number of these windows corresponds to that of the rotatable drums, and in this embodiment three windows **5*a*, 5*b*, and 5*c* are provided. The casing 1 is further provided on its one side with an actuating lever 6 by means of which the mechanism is put in motion. The lower end of the actuating lever 6 is fastened to a boss 7 which is secured to one end of a supporting shaft that projects out through the side wall of the casing 1** and serves to drive the mechanism which will be described later.

The casing 1 contains the rotatable drums and mechanisms for driving them, stopping them, detecting their stop positions and discharging coins. As shown in FIG. 2–5, these rotatable drums and mechanisms are supported by a frame 8 provided inside the casing 1.

Three rotatable drums **9*a*, 9*b* and 9*c* in this embodiment are rotatably mounted on a drum shaft 10 provided between the right and left side plates of the frame 8. The rotatable drums 9*a*, 9*b* and 9*c* are disposed at suitable intervals so that portions of their peripheries are visible through the windows 5*a*, 5*b* and 5*c* with which the casing 1 is equipped. In this embodiment, each rotatable drum has a hub protruding toward an adjacent rotatable drum, and between the rotatable drums 9*a*, 9*b* and 9*c* cylindrical spacers 11 are mounted on the drum shaft 10. Each of the rotatable drums 9***a*, 9*b* and 9*c* is provided on its periphery with several kinds of suitably spaced pictures, symbols, etc., representing a lemon, cherry, bell or the like. Each of said drums is integrally provided on its one side with a notched disc 13 having notches 12 and 12' in positions corresponding to the pictures, symbols, etc. The notches 12' corresponding to some of the pictures, symbols, etc., are deeper than the notches 12 corresponding to the other pictures, symbols, etc.

The frame 8 is provided below the drum shaft 10 with the supporting shaft 14 for the driving mechanism of said drums. Inside the frame 8, a kicker 15 for rotating said drums at the same time is movably attached to the supporting shaft 14. The kicker 15 has projections 15*a*, 15*b* and 15*c* disposed so that they can kick the notched discs 13 of the rotatable drums 9*a*, 9*b* and 9*c* respectively. The kicker 15 is always pulled clockwise by a spring 16 set between the kicker 15 and the frame 8. (In this Specification, the clockwise or counterclockwise direction shows the direction of rotation or turn when seen from the right side of the slot machine). The kicker 15 also has a click 17 which protrudes from the frame 8 through its side plate 8' on the actuating lever side.

An end of the supporting shaft 14 on the actuating lever side protrudes from the frame 8 through its side plate 8', and to this end of the shaft the actuating lever 6 is fastened through the boss 7 as mentioned above. Provided between the boss 7 and the side plate 8' is a hook 18 for turning the kicker 15 counterclockwise against the force of the spring 16. The hook 18 is pivotally attached to a supporting frame 19 rotatably fitted to the supporting shaft 14 so that the hook 18 engages and disengages the click 17 of the kicker 15 as it turns on the pivot. The lower end of the hook 18 takes the shape of a circular arc and serves as its cam portion 20. A spring 21 is incorporated around the pivot of the hook 18 in such a way that it always pulls the hook 18 clockwise in relation to the supporting frame 19. Another spring 22 is set between the supporting frame 19 and the frame 8 in such a way that it always pulls the whole supporting frame 19 clockwise. The supporting frame 19 is rigidly secured to the boss 7 of the actuating lever 6 so that it turns together with the actuating lever 6. In this embodiment, the supporting frame 19 is fitted in a recess 23 provided on one side of the boss 7. The side plate 8' of the frame 8 is provided on its outer surface with an inclined plane 24 which the cam portion 20 of the hook 18 contacts when the supporting frame 19 has been turned counterclockwise by a certain angle by means of the actuating lever 6.

Inside the frame 8, a movable frame 25 of a rectangular shape is mounted on the supporting shaft 14. The movable frame 25 surrounds the kicker 15 so that the top of its side plate abuts on the click 17 of the kicker 15. The movable frame 25 is provided at its front end with projections 26*a*, 26*b* and 26*c* projecting upwardly therefrom. These projections are for detecting the stop positions of the rotatable drums 9*a*, 9*b* and 9*c*, and are disposed at intervals so that they can enter the notches 12 and 12' of the notched discs 13 of the rotatable drums. The rear end of the movable frame 25 serves as a control portion 27 for drum stoppers which are to be described later. A spring 28 is set between the rear of the movable frame 25 and the frame 8 in such a way that it pulls the movable frame 25 clockwise.

On the rear of the frame 8, a back plate 29 is fastened and drum stoppers 30*a*, 30*b* and 30*c* corresponding to the rotatable drums 9*a*, 9*b* and 9*c* are disposed on the top of the back plate 29. The drum stoppers, each of which has a notch 31 at its lower end, are movably mounted on the back plate 29 with the notches 31 fitted in indentations 32 formed at the top of the back plate 29. Springs 34 are set between the back plate 29 and hook portions 33 provided at the lower ends of the drum stoppers so that the upper front ends of the drum stoppers are always pulled forward (toward the rotatable drums). The drum stoppers 30*a*, 30*b* and 30*c* have a shape that in general resembles the letter "F". The front end of the upper arm of each stopper is somewhat pointed or otherwise shaped so as to be capable of entering the notches of the notched discs 13 of the rotatable drums when the drum stoppers 30*a*, 30*b* and 30*c* fall forward by the force of the springs 34. Each drum stopper 30*a*, 30*b* and 30*c*, from about its mid-section downward is provided with a cam portion 35*a*, 35*b* and 35*c* respectively which inclines forward. These cam portions differ in the degree of inclination one from the other. In this embodiment, for instance, the drum stoppers are arranged from left (30*a*) in the order of decreasing degree of inclination of the cam portions. The control portion 27 at the rear end of said movable frame 25 is in sliding contact with the cam portions 35*a*, 35*b* and 35*c*, and keeps the drum stoppers 30*a*, 30*b* and 30*c* upright against the force of the springs 34.

A mechanism for discharging coins is attached to the back plate 29 as follows: A coin magazine 36 is attached to the outer surface of the back plate 29. The upper end of the coin magazine 36 is connected with the coin slot 2 provided at the top of the casing 1, and the lower end of the coin magazine 36 is connected with the coin outlet 3 provided at the bottom of the casing 1. The coin magazine 36 is provided at its lower open end with a bottom plate 37 which is supported on a pivot 37*a*. The bottom plate 37 is kept closed and serves as the bottom of the coin magazine 36 when its edge is supported on a latch 38 attached to the back plate 29, and it turns downward under the weight of coins to open the lower end of the coin magazine 36 when the latch 38 comes off said edge. Referring to the latch 38 in detail, it is pivotally attached below the drum stoppers 30*a*, 30*b* and 30*c* to the back plate 29. Normally, the latch 38 is kept in a vertical position by its own weight and supports the bottom plate 37 with its step portion 39 provided at its lower portion. The latch 38 has a tapered portion 40 above its pivot and is designed to turn when the rear end 27 of said movable frame 25 contacts the tapered portion 40. The back plate 29 is also provided with a push rod 41 by means of which the latch 38 is manually turned. The push rod 41 is disposed so that one of its ends can abut on the lower end of the latch 38 and the other end protrudes from the casing 1. A spring 42 is provided between the push rod 41 and the back plate 29 in such way that the forward end of the push rod 41 is usually kept away from the latch 38.

Figure 5:
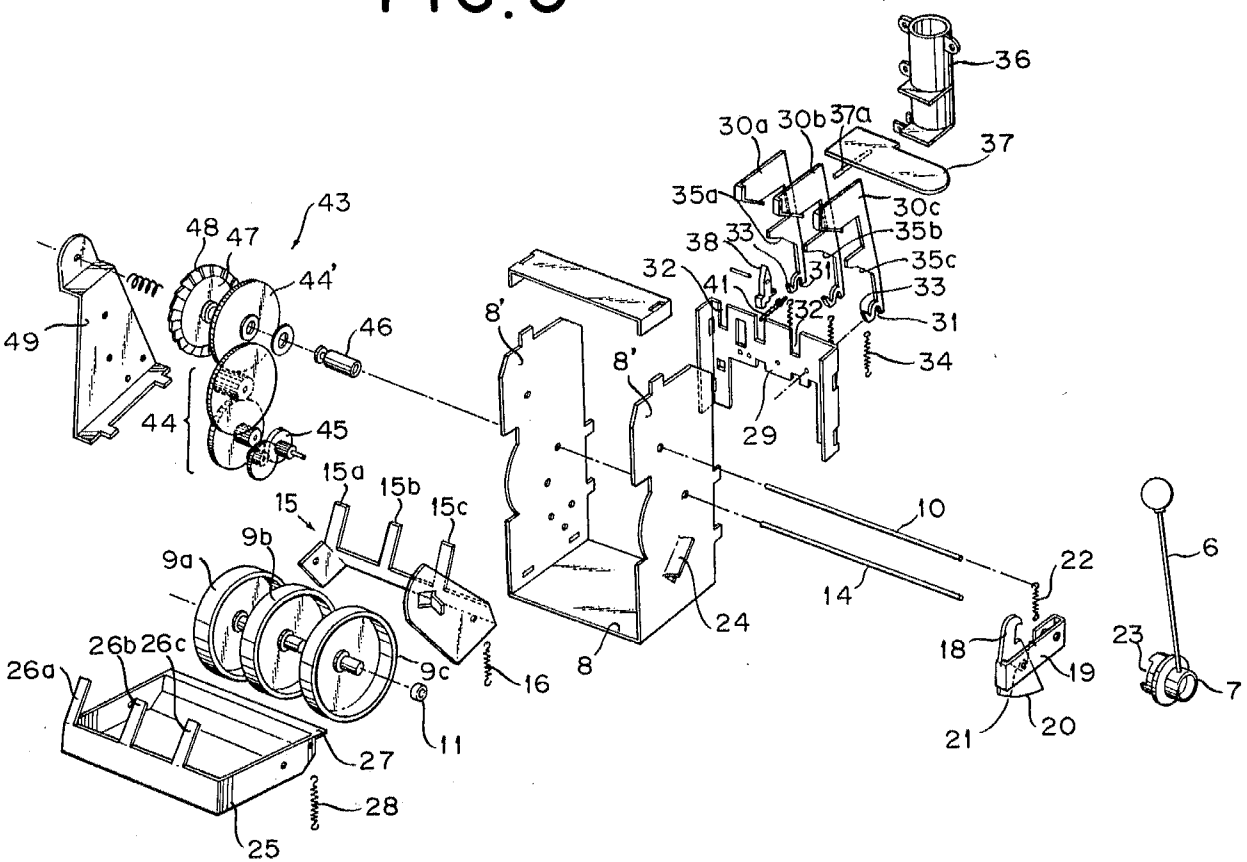
FIG. 5 is an exploded view in perspective illustrating the construction of said slot machine.
Figure 6:
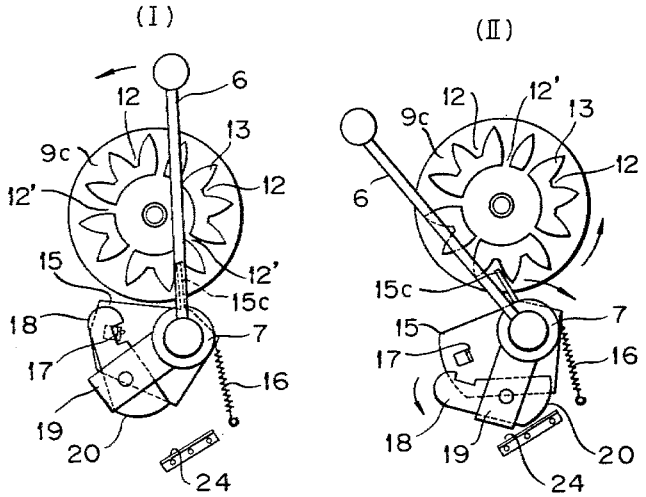
FIG. 6 (I), (II) are side views illustrating the relation between a kicker and a drum.
Figure 7:
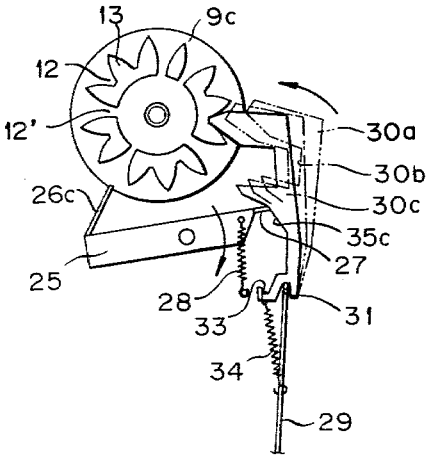
FIG. 7 is a side view illustrating the relation between a movable frame and a stopper.

The end of said supporting shaft 14 on the side opposite to the actuating lever 6 protrudes from the side plate 8' of the frame 8 and is provided with a timing mechanism 43 interlocking with the movable frame 25; see FIG. 5. The timing mechanism 43 comprises a plurality of speedup gears 44 and a flywheel 45 which is rotated at a high speed by the speedup gears 44. Numeral 49 represents a supporting plate attached to the outer surface of the side plate 8' to support the shafts of the speedup gears 44 and flywheel 45. The first gear 44' in the speedup gears 44 is rotatably fitted to a bushing 46 mounted on the supporting shaft 14. By the side of the gear 44', a clutch plate 47 is rigidly secured to the bushing 46. The clutch plate 47 and the gear 44' are provided on their contact surfaces with toothed surfaces 48 adapted to engage with each other in one direction only, thus the clutch plate 47 and gear 44' forming a one-way clutch. The other end of the bushing 46 mounted on the supporting shaft 14 is extended inwardly through the side plate 8' of the frame 8 and is fastened in a shaft hole provided on the side of the movable frame 25. Thus it follows that, through the bushing 46, the movable frame 25 and clutch plate 47 are interlocked with each other and turned as one body on the supporting shaft 14.

The operation of the slot machine of this invention will now be explained. When the actuating lever 6 is pulled forward, the supporting frame 19 rigidly secured through the boss 7 to the actuating lever 6 and the hook 18 pivotally attached to the supporting frame 19 are turned counterclockwise. Because the hook 18 is engaged with the click 17 of the kicker 15, the kicker 15 is turned counterclockwise against the force of the spring 16 as the hook is turned. At the same time, the movable frame 25 is also turned counterclockwise by the click 17 of the kicker 15. Thus the control portion 27 at the rear end of the movable frame 25 rises while sliding on the cam portions **35*a*, 35*b* and 35*c* of the drum stoppers 30*a*, 30*b* and 30*c*, and pushes the drum stoppers backward, away from the drums. Therefore, the upper front ends of the drum stoppers 30*a*, 30*b* and 30*c* come off the notched discs 13 and the rotatable drums 9*a*, 9*b* and 9*c* are now ready to rotate freely. When the actuating lever 6 is pulled forward further, the cam portion 20 at the lower end of the hook 18 comes in contact with the inclined plane 24 on the side plate 8', and the hook 18 is turned on the inclined plane 24 counterclockwise in relation to the movable frame 25. As a result, the hook 18 comes off the click 17 of the kicker 15, and the kicker 15 is quickly returned clockwise by the accumulated force of the spring 16. At that time, the kicker 15 rotates all the rotatable drums 9*a*, 9*b* and 9*c* counterclockwise simultaneously by kicking their notched discs 13 with its projections 15*a*, 15*b* and 15*c***.

When the kicker 15 starts to return toward its original position by the action of the spring 16, the movable frame 25, which has been turned by the kicker 15, starts to turn clockwise by the returning action of the spring 28. At this time, the movable frame 25 turns slowly because it is connected through the clutch plate 47 with the timing mechanism 43. Reference will now be made to this point in detail: When the movable frame 25 is turned counterclockwise by pulling the actuating lever 6 as mentioned above, the one-way clutch consisting of the clutch plate 47 and gear 44' does not set the speedup gears 44 in the timing mechanism 43 in motion and therefore the movable frame 25 at first turns quickly and with no resistance together with the kicker 15. However, when the movable frame 25 starts to turn clockwise toward its original position, the one-way clutch, which is now in an engaged state, lets the speedup gears 44 rotate together with the movable frame 25, and therefore its returning speed is slowed down.

When the movable frame 25 slowly returns toward its original position and the control portion 27 at its rear end slowly moves down while sliding on the cam portions **35*a*, 35*b* and 35*c*, the drum stoppers 30*a*, 30*b* and 30*c*, which have been pushed back by the control portion 27, start to incline forward by the force of the springs 34. The cam portions 35*a*, 35*b* and 35*c* of the drum stoppers 30*a*, 30*b* and 30*c* differ in the degree of inclination from one another as mentioned above, and the drum stopper having the greatest degree of inclination of its cam portion falls forward first. Therefore, the upper front ends of the drum stoppers 30*a*, 30*b* and 30*c* move into the notches of the notched discs 13 of the rotatable drums 9*a*, 9*b* and 9*c*** one after another, thus stopping the rotatable drums in regular sequence and at intervals.

Figure 8:
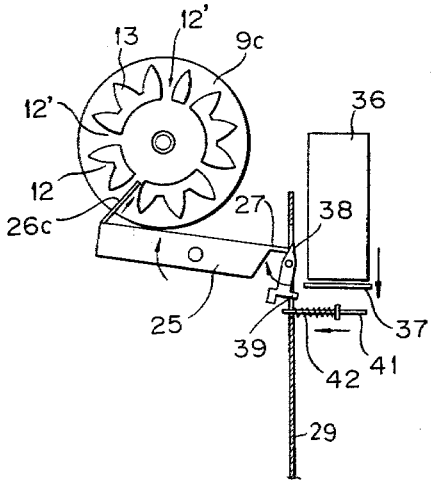
FIG. 8 (I), (II) are side views illustrating the relation between said movable frame and a latch for coin discharge.
Figure 8:
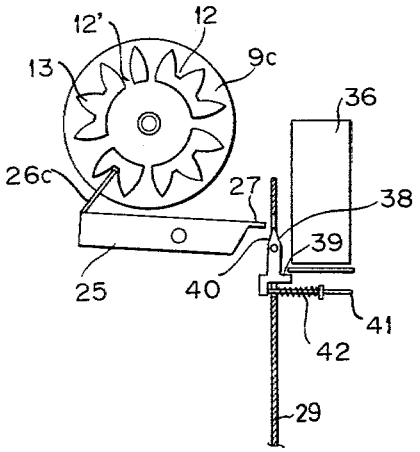

As the movable frame 25 slowly returns toward its original position, the projections **26*a*, 26*b* and 26*c* at its front end approach the notched discs 13 of the rotatable drums 9*a*, 9*b* and 9*c* and, after the rotatable drums have stopped, each of the projections enters either the shallow notch 12 or deep notch 12' of each notched disc 13. If the rotatable drums 9*a*, 9*b* and 9*c* stop in positions where a predetermined combination of pictures, symbols, etc., is visible through the windows 5*a*, 5*b* and 5*c* of the casing 1, the deep notches 12' of their notched discs 13 are arranged in the same position and all the projections 26*a*, 26*b* and 26*c* of the movable frame 25 move in deep, closer toward the center of the notched discs 13; see FIG. 8(I). In this case, the control portion 27 at the rear end of the movable frame 25 comes down below the cam portions of the drum stoppers, and turns the latch 38 clockwise to let it come off the bottom plate 37 of the coin magazine 36. Then, the bottom plate 37 turns downward under the weight of coins to open the lower end of the coin magazine 36. Now coins drop through the open end into the coin outlet 3 provided at the bottom of the casing 1. On the other hand, if the rotatable drums 9*a*, 9*b* and 9*c* stop in positions other than where a predetermined combination of pictures, symbols, etc., are visible through the windows 5*a*, 5*b* and 5*c*, at least one of the projections 26*a*, 26*b* and 26*c* of the movable frame 25 enters into a shallow notch 12 and abuts on its bottom, preventing the movable frame 25 from turning any further; see FIG. 8(II). In this case, the control portion 27 at the rear end of the movable frame 25 does not come down to the latch 38. Thus the bottom plate 37 of the coin magazine 36 is still supported in place by the latch 38** even after the rotatable drums have stopped, and no coins are discharged.

The slot machine of this invention is thus designed to discharge coins only when a predetermined combination of pictures, symbols, etc., is visible through the windows **5*a*, 5*b* and 5*c* after the rotatable drums have stopped. To recover coins from the coin magazine 36, for instance, after the end of the game, the end of the push rod 41 protruding from the casing 1 is pushed. Then, the other end of the push rod 41 turns the latch 38 and lets it come off the bottom plate 37 of the coin magazine 36. Now the lower end of the coin magazine 36** is opened, and coins in it drop through the open end into the coin outlet.

The present invention has the following advantages. This slot machine is easy to operate and pleasant to use for anybody, even a child, because it is designed to automatically perform all the operations from starting the rotatable drums to stopping them and discharging coins solely by pulling the actuating lever once at the start of the game. In addition, this invention insures the fairness of the game and creates interest in it, because the rotatable drums automatically stop in regular sequence and at intervals and therefore the positions where they start or stop vary with the game and haphazard and various combinations of pictures, symbols, etc. appear in the windows. Furthermore, this invention gives the player the pleasure of anticipating the result of the game for a period of time because the action of the drum stoppers is controlled; the return of the movable frame (and consequently the movement of its control portion) is slowed down by the timing mechanism and therefore the drums do not stop immediately after being started but continue to rotate for a certain period of time.

Particularly, according to the present invention, it is possible to perform the complicated operation of stopping the rotatable drums in regular sequence and at intervals by the simple structure of giving different shapes to the cam portions of the drum stoppers. Also, it is possible to perform the functions of controlling the drum stoppers, detecting the stop positions of the drums and discharging coins through the movement of the single movable frame. Therefore, the whole slot machine can be made smaller and simpler. Furthermore, the slot machine of this invention is inexpensive, functions dependably and has a lot mechanical failure rate as compared with those equipped with an electric motors, etc., because its parts are designed to move by the force of springs.

While the invention has been described in its preferred embodiments, it is to be understood that modifications will occur to those skilled in the art without departing from the spirit of the invention. The scope of the invention is therefore to be determined solely by the appended claims.

What is claimed is:

1. A mechanical slot machine comprising:

a plurality of drums rotatably mounted on a drum shaft, each of said drums having a notched disc with shallow notches and deep notches, a kicker and a movable frame both mounted on a supporting shaft disposed below the drum shaft, said kicker and movable frame both being always pulled in one direction by a respective spring, said kicker having projections for kicking the notched discs of the drums respectively, said movable frame having projections disposed for insertion into the notches of the notched discs of the drums respectively, and having a control portion for drum stoppers, said movable frame interlocking through a one-way clutch with a timing mechanism, an actuating lever and a hook adapted to turn therewith both mounted on one end of the supporting shaft, said hook disengageably engaging the kicker and the movable frame so as to disengage them when they have been turned by a certain angle against the force of the springs, and drum stoppers disposed for the drums respectively and always pulled toward the respective drums by springs, said drum stoppers having respective cam portions being different in shape from one another, said control portion of the movable frame abutting on the cam portions so as to let the drum stoppers engage and disengage the drums.

2. A mechanical slot machine as claimed in claim 1, having a coin magazine and a latch normally supporting the bottom plate of the coin magazine so as to keep the bottom plate closed, said latch being adapted to be pushed by said control portion of the movable frame so as to open the bottom plate.

3. A mechanical slot machine as claimed in claim 1 or claim 2, having a supporting frame mounted on said supporting shaft and rigidly secured to said actuating lever, said hook being pivotally attached to the supporting frame and pulled in one direction by a spring, said hook being formed with a cam portion, and an inclined plane for turning said hook by contacting the cam portion thereof when the supporting frame has been turned by a certain angle.

4. A mechanical slot machine as claimed in claim 3, wherein said kicker is provided on its one side with a click engaging and disengaging the hook, said click being adapted to contact a portion of the movable frame so that, as the kicker is turned by means of the actuating lever, the movable frame is turned in the same direction.

5. A mechanical slot machine as claimed in claim 1, wherein said timing mechanism comprises a plurality of speedup gears and a flywheel at one end thereof, said one-way clutch comprising the first gear in the timing mechanism and a clutch plate, said gear being mounted on the supporting shaft, said clutch plate being mounted on the same shaft by the side of the said gear and interlocking with the movable frame, said gear and said clutch plate being provided on their contact surfaces with toothed surfaces adapted to engage with each other in one direction only.

* * * * *